United States Patent [19]

Osterberg

[11] Patent Number: 4,614,110

[45] Date of Patent: Sep. 30, 1986

[54] DEVICE FOR TESTING THE LOAD-BEARING CAPACITY OF CONCRETE-FILLED EARTHEN SHAFTS

[76] Inventor: Jorj O. Osterberg, 4049 Bunker La., Wilmette, Ill. 60091

[21] Appl. No.: 717,536

[22] Filed: Mar. 29, 1985

Related U.S. Application Data

[63] Continuation-in-part of Ser. No. 618,594, Jun. 8, 1984, abandoned.

[51] Int. Cl.[4] ..... G01N 3/24

[52] U.S. Cl. ..... 73/84; 73/784

[58] Field of Search ..... 73/784, 84, 803

[56] References Cited

U.S. PATENT DOCUMENTS

| | | | |
|---|---|---|---|
| 3,503,254 | 3/1970 | Menard | 73/784 |
| 3,633,408 | 1/1972 | Johnston, Jr. | 73/784 |
| 4,315,429 | 2/1982 | Morozov et al. | 73/84 |

FOREIGN PATENT DOCUMENTS

| | | | |
|---|---|---|---|
| 150089 | 8/1981 | German Democratic Rep. | 73/784 |
| 585397 | 12/1977 | U.S.S.R. | 73/784 |

*Primary Examiner*—Stewart J. Levy
*Assistant Examiner*—Joseph W. Roskos
*Attorney, Agent, or Firm*—Louis Bernat

[57] ABSTRACT

A device which separately measures the skin friction and the load-bearing capacity of the earth at the bottom of a hole. An expansion device is in the bottom of the hole, with a shaft resting on top it. A pressurized fluid is pumped into the expansion device, via a coaxial pipe and rod, to fill and expand it. By observing the movements of the rod and pipe responsive to the expansion and relative to the ground surface, it is possible to record the pressure versus upward movement of the shaft and the pressure versus downward movement of the earth below the bottom of the shaft. The ultimate or maximum skin friction is indicated when the load-upward movement curve plotted from the data indicates no further increase in load with upward movement. The ultimate end bearing capacity is indicated when the load-downward movement curve indicates no further increase in load with downward movement. When the shaft has concrete poured down the hole, the expansion device may be a bellows-like affair with the rod connected to the bottom of the bellows and the pipe connected to the top. When the shaft is a driven pile, the expansion device is a massive piston which can withstand the driving forces.

21 Claims, 20 Drawing Figures

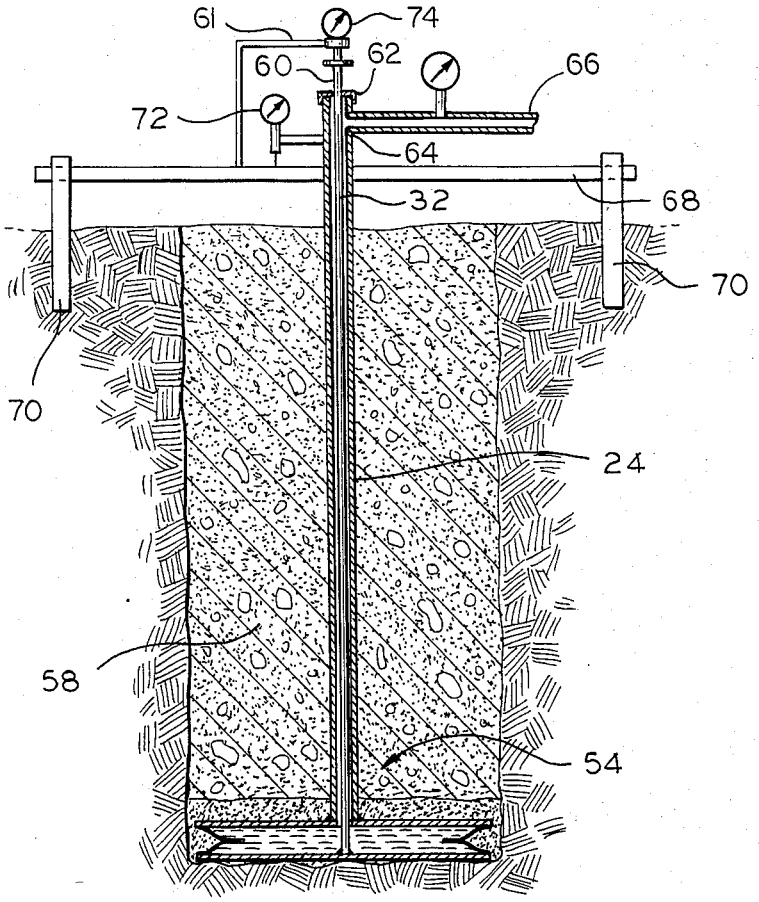
FIG.6
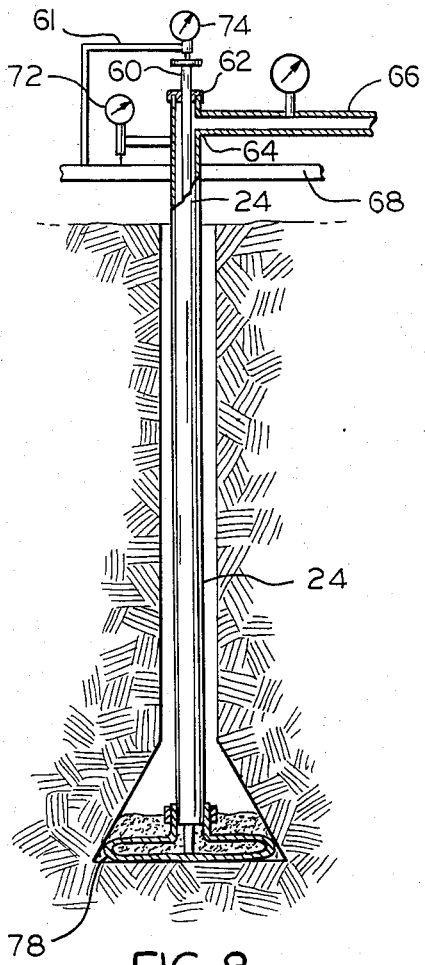
FIG. 8
FIG. 7A
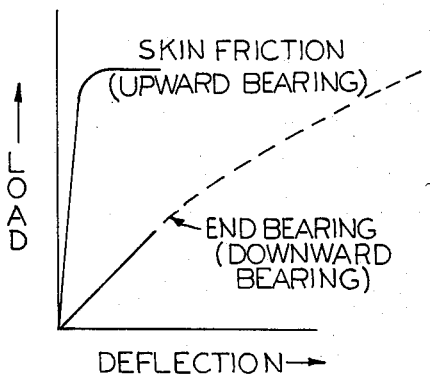
FIG. 7B
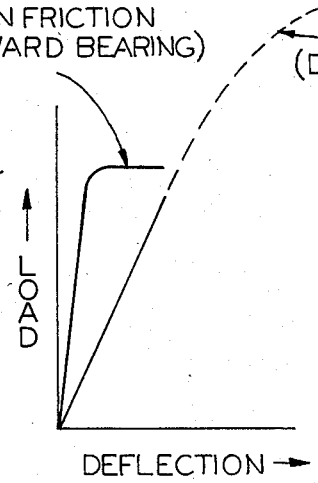
FIG. 7C
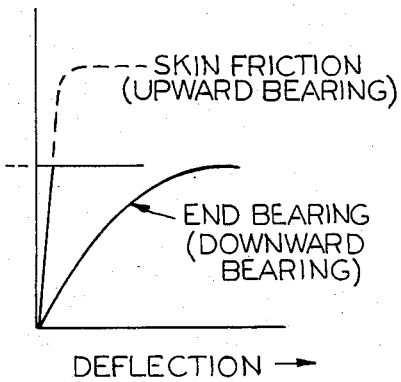

DEVICE FOR TESTING THE LOAD-BEARING CAPACITY OF CONCRETE-FILLED EARTHEN SHAFTS

This is a continuation-in-part application of U.S. patent application Ser. No. 618,594, filed June 8, 1984 now abandoned.

This invention relates to means for and methods of testing the load-bearing capacity of concrete shafts extending down in the earth and more particularly to means for conducting such tests responsive to an application of approximately one-half of the force heretofore required for making similar tests.

Conventional load tests use one or more hydraulic jacks to apply a downward load onto the top of a concrete-filled shaft to determine the ultimate load-carrying capacity of the underlying earthen support. The downward movement of the top of the shaft is measured under suitable vertical load. To accomplish this, the jacks must react against either a dead load or a heavy beam which is held down on each of its ends by reaction shafts which are designed to take an upward force. Since the load capacity of the shafts range from hundreds to thousands of tons, and since the required reaction load must be greater than the total test load, there must be either a huge pile of weights (generally concrete blocks or steel) or a very heavy and strong reaction hold-down system. In either case, it is expensive and time consuming to build and later remove such a reaction load. The inventive device eliminates the need for a reaction system and shortens the time required for conducting a test, thereby greatly reducing the cost.

A resume of some prior art methods of performing conventional tests is found in an article entitled "Methods of Improving the Performance of Drilled Piers in Weak Rock" by R. G. Horvath, T. C. Kenney, and P. Kozicki, published in the Canadian Geotechnical Journal, Vol. 20, 1983, pages 758–772. In general, this article describes pier sockets drilled in weak rock, which hold concrete piers. Jacks are used to measure the loads which the supporting rock underlying the pier may carry. This article describes equipment which requires an application of the full amount of force exerted by the jacks to press the piers into the earth.

Accordingly, an object of the invention is to provide new and novel means for and methods of measuring the load-bearing capacity of the earth. Here an object is to reduce the forces required to make such tests by approximately 50%, as compared with the forces required by previously used equipment.

In keeping with an aspect of the invention, in one embodiment, these and other objects are accomplished by providing two spaced, parallel circular plates having a diameter which is either the same as or is slightly smaller than the diameter of an excavated hole, which is filled with concrete after the plates have been positioned in the bottom of the hole. These plates are held together at their circumferences by a flexible, somewhat bellows-like arrangement which enables pressure to be applied inside the device and between the plates. This pressure causes the plates to separate about two inches while remaining parallel to each other, in order to lift the shaft or to press the earth downwardly under the shaft, or both. The device may be made of steel, but it can also be made of a rigid plastic material, of rubber, or of concrete. Attached to the device is an inside rod which is passed through a hole in the top plate and is welded to the bottom plate. An outside pipe coaxially contains the rod and is welded to the upper plate. A fluid pressure is applied through the pipe to the interior of the device. The fulid can be water, oil or air, or it may be a cement grout. As the fluid pressure makes the two plates spread away from each other, the forces are multiplied by their action in two directions, thereby dividing by one-half the total amount of force that is required. The relative positions of the rod and pipe may be observed to detect the amount of upper and lower plate movements. Any upward movement of the shaft is indicated by an upward movement of the pipe and is a measurement of the skin friction between the shaft and the walls of the hole. Any downward movement of the rod is a measurement of the underlying earthen support.

In another embodiment, the spaced parallel plates at the bottom of the shaft are replaced by a massive piston which is sealed inside the pipe by suitable O-rings. The piston can be pressed downwardly with substantially more force because it has a much more massive structure.

Preferred embodiments of the invention are shown in the attached drawings wherein.

Figure 5A:
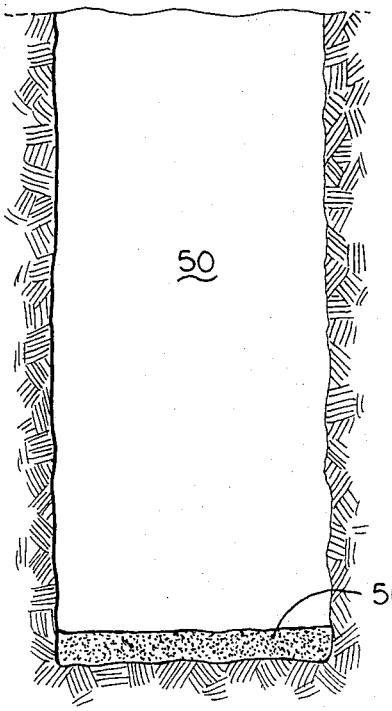
Figure 5B:
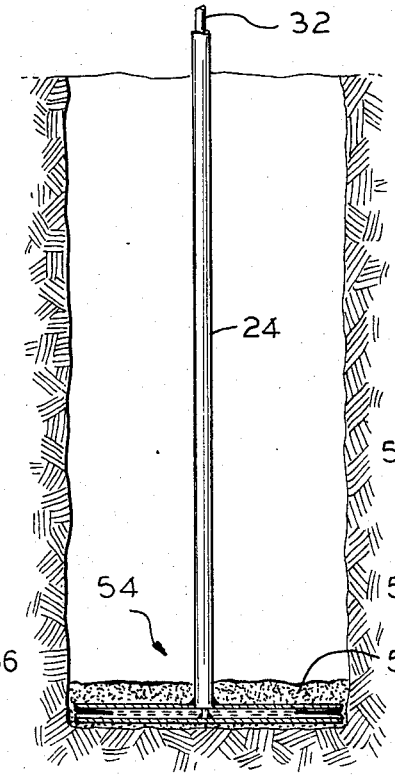
Figure 5C:
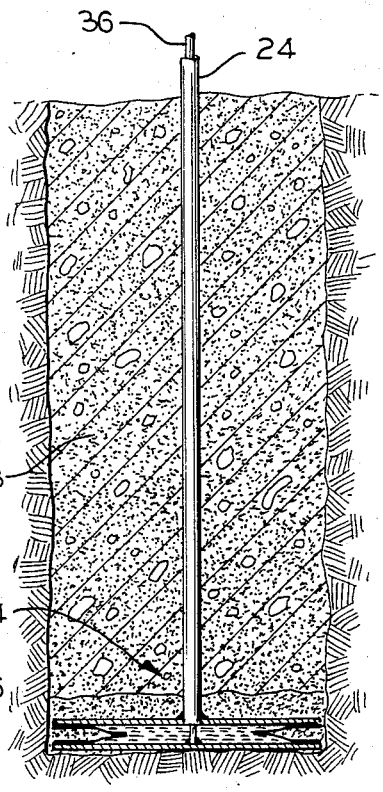
Figure 9:
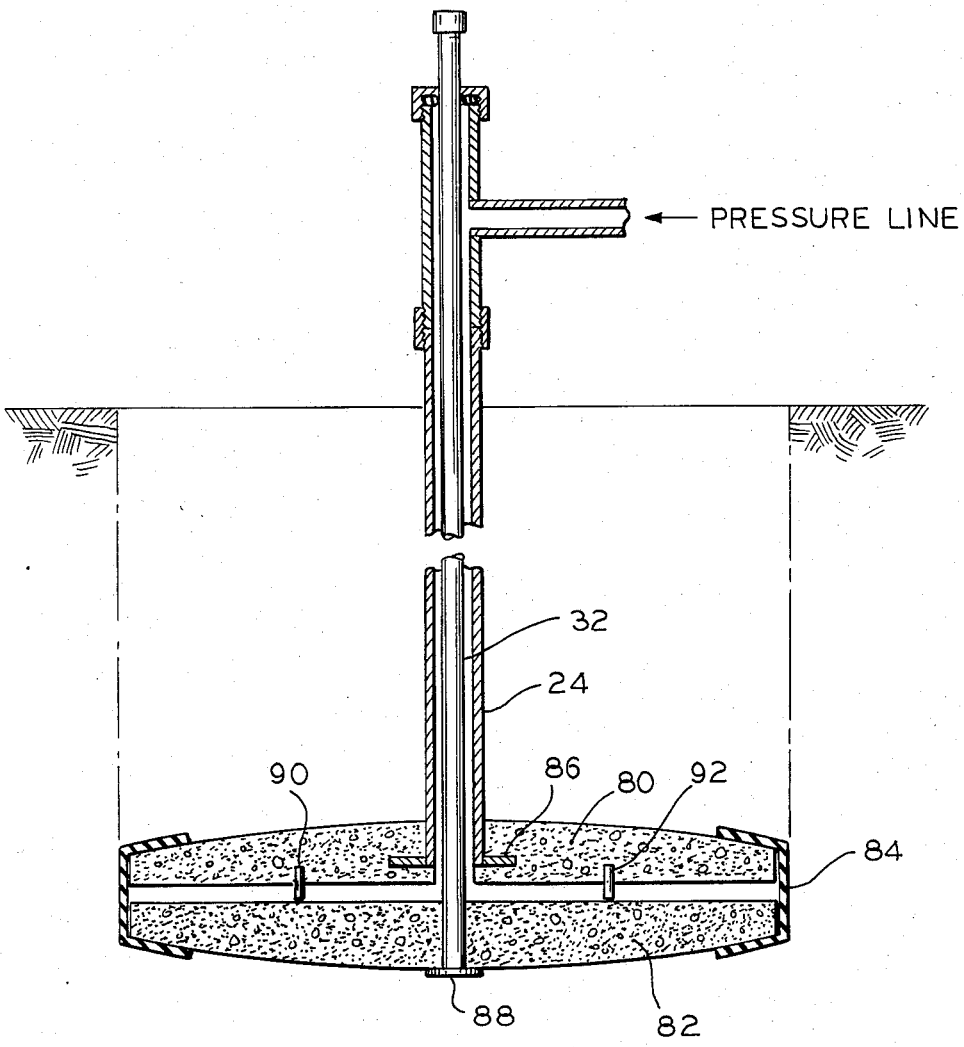
Figure 10:
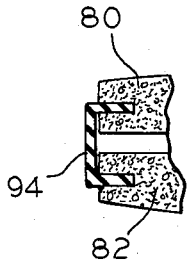
Figure 11:
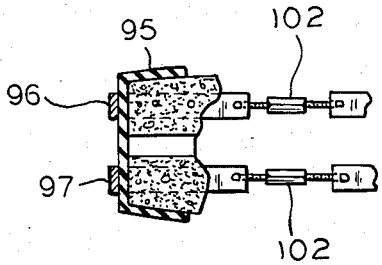
Figure 12:
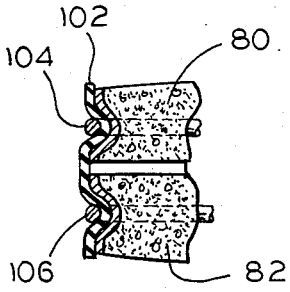

FIG. 5 has three stop-motion views showing a cross-section of a hole in the earth, the views illustrating the sequence of the inventive method that is, FIG. 5A shows the open hole after it has been dug and the bottom has been leveled by a layer of grout; FIG. 5B shows the same hole after the inventive device has been lowered into position; and FIG. 5C shows the same hole after it has been filled with cement;

FIG. 6 is a cross-section of a hole in the earth with associated instrumentation to measure the load-bearing capabilities of the earth;

FIG. 7 includes three graphs showing the readings which might reasonably be expected depending upon the relationship between the bottom load-bearing capability and the skin friction between the perimeter of the shaft and the surrounding hole walls that is, FIG. 7A is a load-deflection curve when the end bearing and skin friction are approximately equal; FIG. 7B is the deflection curve when the end bearing greatly exceeds the skin friction; and FIG. 7C is the deflection curve when the skin friction greatly exceeds the end bearing;

FIG. 8 is a cross-section of a second embodiment showing tests being conducted on a concrete shaft;

FIG. 9 shows an alternative embodiment using a rubber casing expansion member, somewhat similar to an automobile tire casing;

FIGS. 10–12 show the alternative embodiments using rubber casings.

Figure 13:
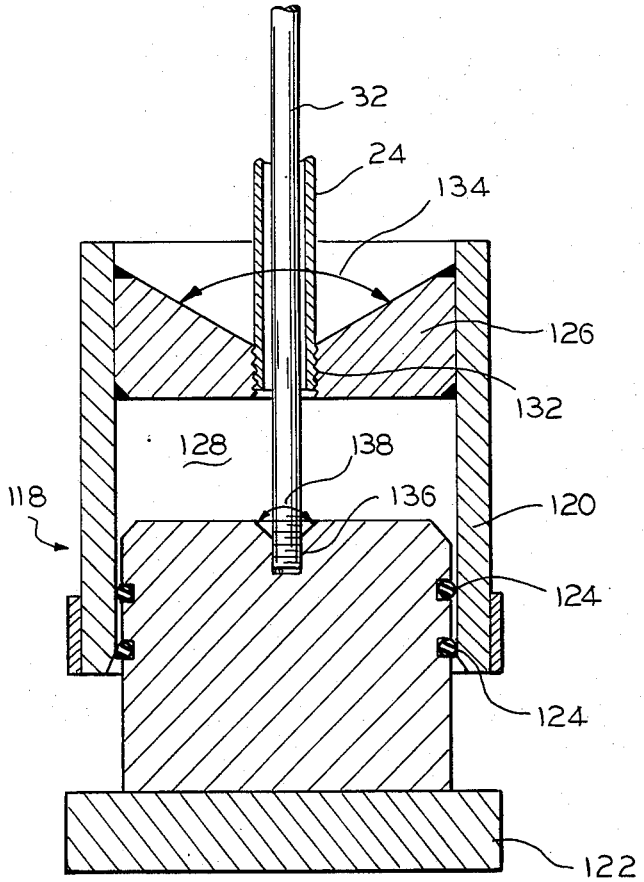
Figure 14:
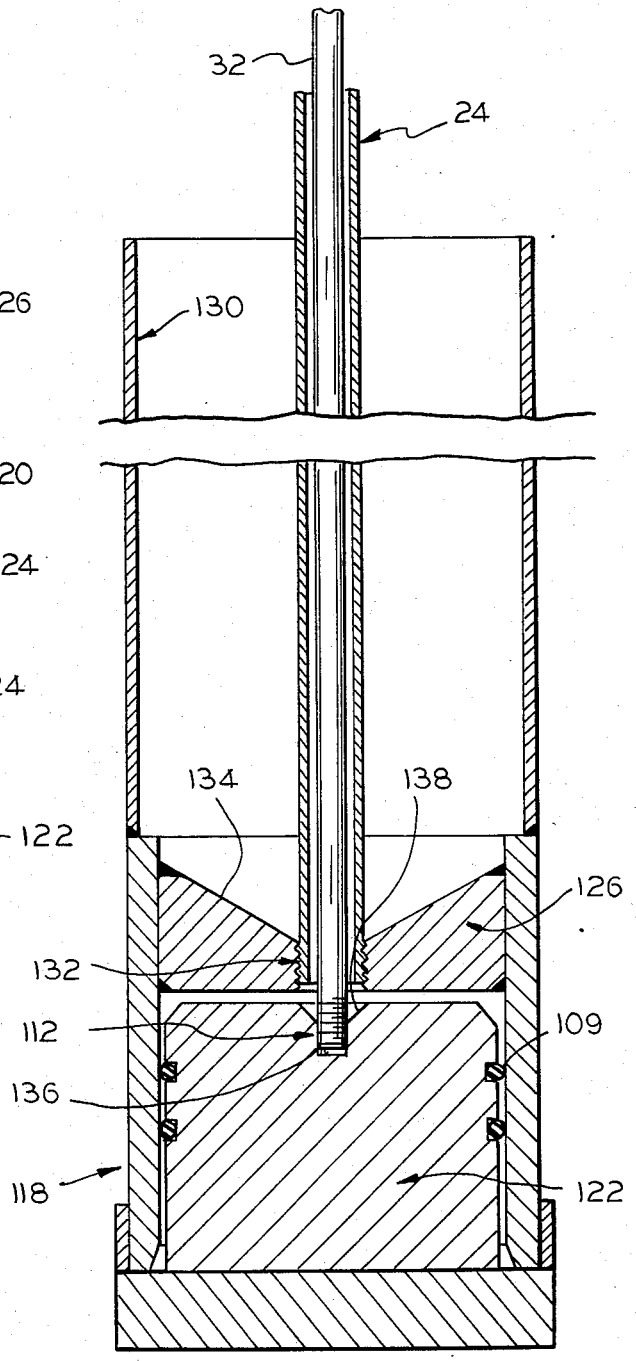
Figure 15:
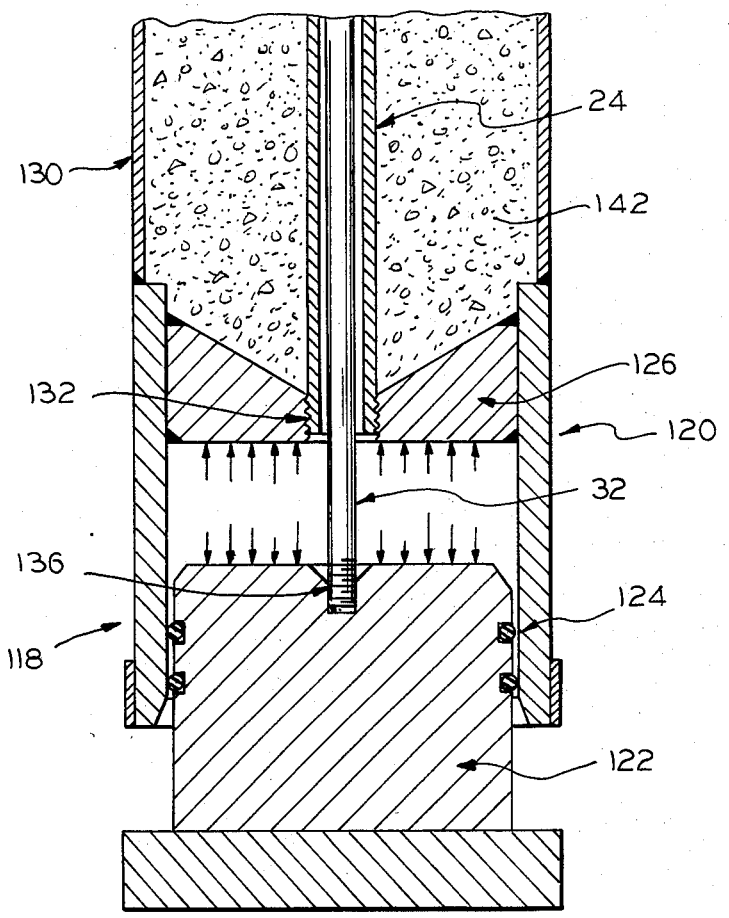
Figure 16:
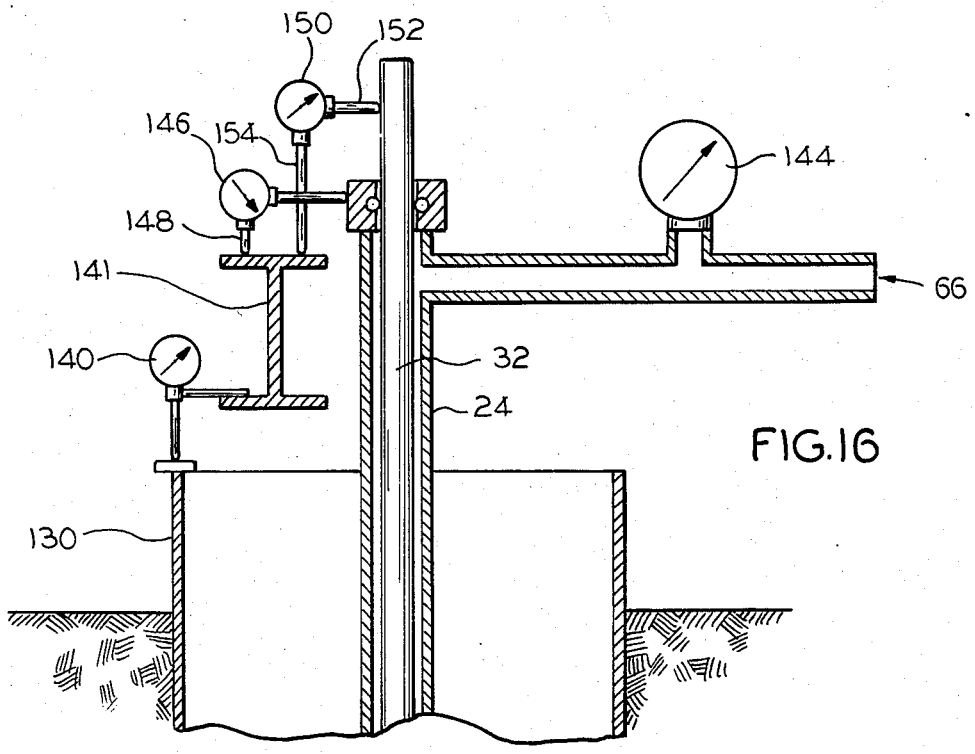

FIG. 13 is a cross-section of a piston type expansion means which forms a third embodiment of the invention;

FIG. 14 is a cross-section of the piston of FIG. 13, in a closed position, attached to the end of a pipe;

FIG. 15 is the same cross-section that is shown in FIG. 14, but with the piston extended; and FIG. 16 shows the instrumentation at the top of the pipe.

In one embodiment, the basic device used by the invention comprises an expansion means in the form of two spaced parallel circular plates 20, 22 placed one over the other, in a face-to-face contact. Preferably, the diameter of the plates is slightly less than the diameter of the hole. For example, if these plates are to be used in an earthen hole which is four feet in diameter, the diameter of the plates may be about three feet, ten or eleven inches and they may be made from approximately one-fourth inch steel plate.

Figure 4:
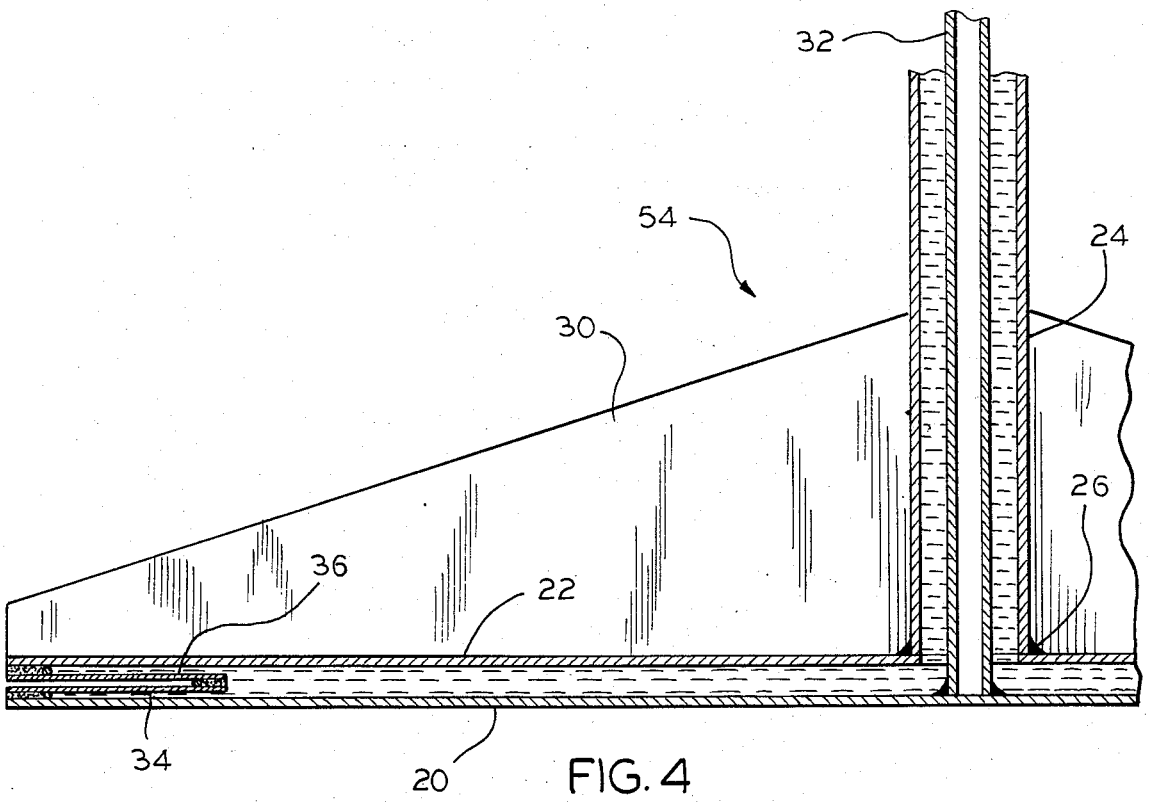
FIG. 4 is a disclosure of the construction of the bottom structure with telescoping pipes attached thereto.

In this four-foot example, the top plate 22 has a center hole which is two inches in diameter, with a pipe 24 welded thereto, at 26. Three or more preferably triangular stiffening plates 28, 30 are welded between the pipe 24 and the top plate 22. A one-inch rod 32 passes through the center of the pipe 24 and is welded to the center of the bottom plate 20. This construction is best seen in FIG. 4.

Two other somewhat doughnut-shaped steel or toroidal plates 34, 36 (FIG. 2) are placed between upper and lower plates 22, 20. In the above described example of four-foot diameter plates 20, 22, the plates 34, 36 may have an outside diameter substantially equal to the diameter of the plates 20, 22. The inside diameter of plates 34, 36 may be about three feet, four inches. Three one-eighth inch diameter wire hoops 38, 40, 42 are positioned at the outside periphery between plates 20, 34 and 22, 36, and at the inside periphery between plates 34, 36. These wire hoops are welded in place to provide stiffness at 44, 46, 48.

Figure 1:
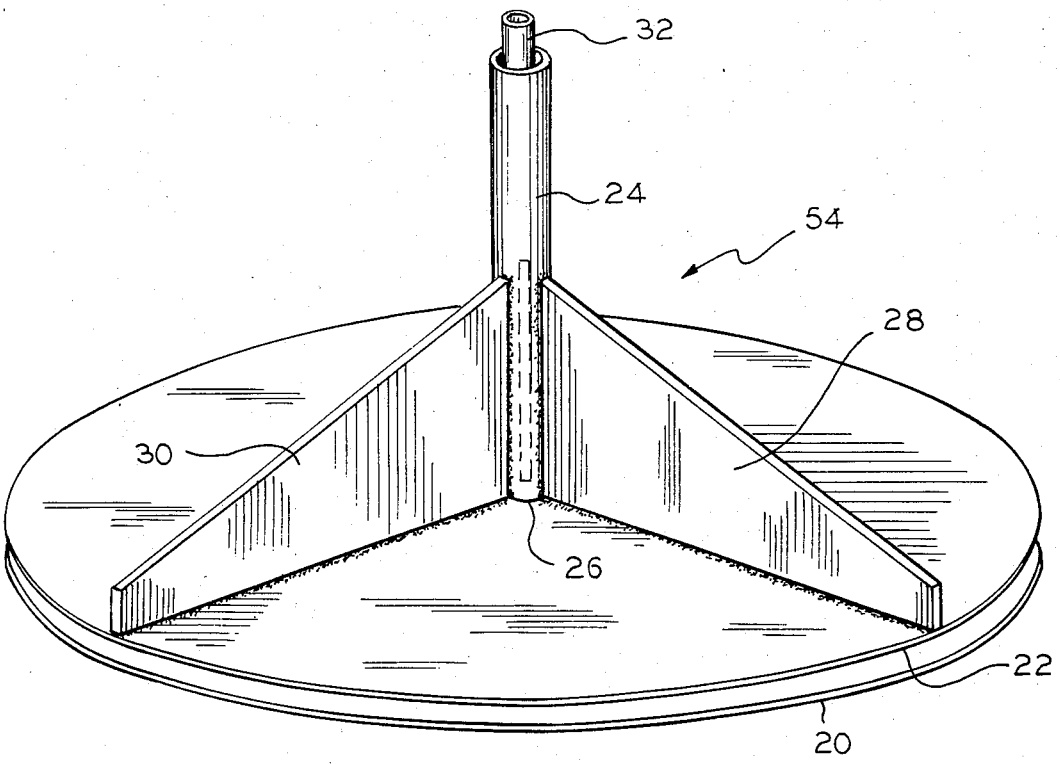
FIG. 1 is a perspective view of a first embodiment of the inventive device having a bellows like expansion means.
Figure 2:
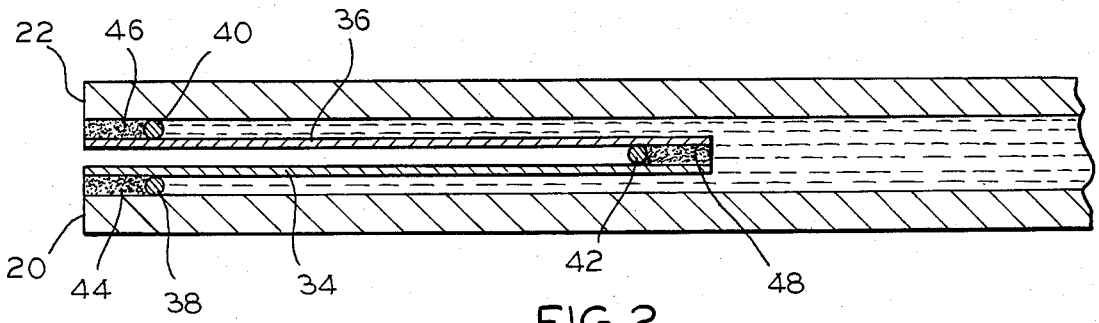
FIG. 2 is a cross-section view of a fragment of a pair of plates before they are forced apart.
Figure 3:
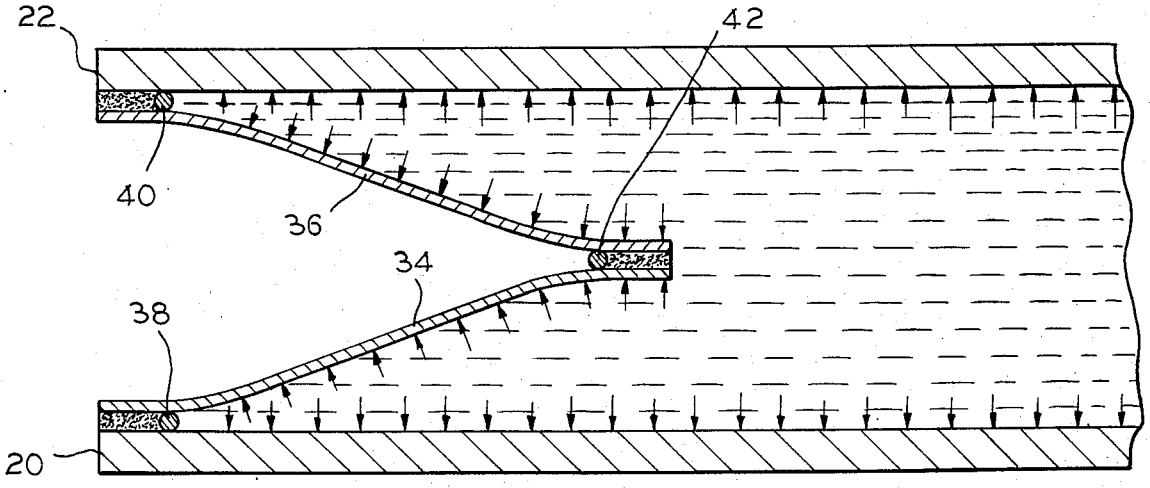
FIG. 3 is a fragmentary view which is the same as FIG. 2, except that the two plates have been forced apart.

In the normal and unused conditions, as seen in FIG. 2, the expansion means or plates 20, 22 are close together, practically in face-to-face contact. When a fluid is pumped down pipe 24, the plates 20, 22 are forced apart (FIG. 3) somewhat similar to the opening of a bellows. The plates 34, 36 expand and the force caused by the internal pressure pushes plate 20 down and against the bottom of the hole, testing its load-bearing capacity. The upward force caused by the internal pressure pushes plate 22 up, thus applying an upwardly acting force upon anything above it. This force is resisted by the downward weight of the concrete and by the force of the soil or rock surrounding the concrete cylinder resisting its upward movement, commonly called "skin friction". The weight of the shaft is usually only a small fraction of the skin friction. Since the pressure applied inside the device (i.e. between plates 20, 22) is equal in all directions, the upward and downward forces are always equal. Thus, in the prior art, to test a concrete shaft by a downward load applied at the top of the shaft, requires twice the load (less the weight of the concrete) to test the same shaft and end bearing resistance. Furthermore, this invention conveniently and easily separates the measurement of shaft resistance (skin friction) from the measurement of the underlying earth support capability for the bottom of the shaft.

The device 54 is installed in an earthen hole 50 which is drilled as shown in FIG. 5. The hole diameter (step 1) can vary from about two to about ten feet and is drilled by any conventional drilling machine, to any suitable depth. The hole is made as clean and flat on the bottom, as possible. If the bottom of the hole can be cleaned so that the device rests on a completely smooth surface, grout may not be required. If a smooth surface is not achieved, a small amount of cement grout 56 is placed in the bottom of the hole (FIG. 5, step 1) in order to even and level it. The inventive device is then lowered into the hole and pressed firmly against the bottom (FIG. 5, step 2). The inside rod 32 and outside pipe 24 are extended upwardly as the device is lowered into the hole, by screwing on additional threaded sections of the rod and pipe.

When the grout has set (if it is used), the hole is filled with concrete 58 in the usual manner in which concrete shafts are filled. When the concrete has set, the shaft is ready for testing.

Before the testing begins, an apparatus is attached to the inventive device for applying the pressure and for measuring the resulting vertical movements, as shown in FIG. 6. A short length of rod 60 is screwed onto the exposed end of rod 32, over which a short section of pipe 61 is attached. The down-hole pipe contains two "O" rings 62 which enable the rod to extend above the end of the pipe, thus allowing the rod 32 to move freely relative to the pipe 24 without leakage of the fluid that is pumped down pipe 24.

A "T" connection 64 is made to the pipe, at a convenient location. The other end of the "T" connects to a pressure hose 66 leading to the pump. The pressurized fluid is forced through hose 66 and into the system.

A firmly fixed reference beam 68 is installed by driving or screwing stakes 70, 70 into the ground, on the ends of a line passing through the center of the shaft. These stakes 70, 70 should be located four feet or more from the concrete-filled shaft. The reference beam 68 is attached to these stakes in order to act as a fixed reference relative to the ground surface for enabling measurements of the vertical shaft movement and of the end bearing movement, when tested under load application. Preferably dials 72 and 74 are capable of measuring movements to 0.001 inches accuracy, over a range of at least two inches of total travel. Dial 72 is attached to the pipe, with the dial tip resting on the upper surface of reference beam 68. This dial measures the upward movement of the concrete shaft 58 as pressure is applied by the inventive device 54 at the bottom of the hole. As the device 54 expands the shaft 58 moves upward.

A second dial 74 with the same accuracy and travel is held by a frame 75 which is attached to the reference beam. The stem of dial 74 rests on the top of rod 60 extending from the inside of the pipe. This dial measures the downward movement of the bottom of the shaft as the load is applied and as the underlying soil or rock deforms under load.

Pressure is applied, in increments, through hose 66 and the resulting movements of the expansion means are translated into movements of the pipe and rod which are read from dials 72 and 74 after each increment. Before installation, the device is calibrated by measuring, in a load testing machine, the external force required to counter a given internal pressure, thus obtaining the internal pressure-total load relationship. For a given specific design and dimensions, only one calibration is necessary since all identical devices will have the same calibration. For each increment of applied pressure, the corresponding total load is known from the calibration curve. Thus, as the test proceeds, the upward load movement of the shaft and the downward load movement of the bottom can be plotted on a graph.

FIG. 7 shows three possible load-deflection curves. Curve A shows the case in which the end bearing or bottom resistance is about equal to the upward frictional capacity of the sidewall of the hole. Curve B shows the case in which the end bearing is much greater than the frictional capacity of the sidewall. Curve C shows the case in which the frictional capacity is greater than the end bearing. In each of the cases of FIGS. 7A, 7B or 7C the dashed portion of the curves are portions which cannot be measured since the shaft has already failed by either skin friction (FIG. 7B) or end bearing (FIG. 7C). From the literature, it is well known that these curves have the shapes shown, on a basis of downward load tests on shafts.

The upward load is always equal to the downward load active on the device 54 at the bottom. Therefore, if a load failure occurs, whether in friction (FIG. 7A) or in end bearing (FIG. 7C), the failure load for a downwardly applied load acting on the top of the shaft 58 is at least twice the test failure load (allowing for the weight of the concrete in the shaft 58).

After a completion of the test, the portion of the testing system above the top of the shaft is removed for reuse and the device at the bottom of the shaft is abandoned. If a cement grout with a retarding agent is used for the pressure fluid, it will harden and the device will become permanently fixed. Thus, the drilled shaft can be used as a permanent shaft to support its designed load.

An advantage of the invention lies in the application of the load at the bottom of the shaft, instead of at the top, because the means for measurement of the load-downward movement of the bottom of the shaft and the load-upward movement of the shaft may be read directly at the top. Only half of the total test load (plus the weight of the concrete) is needed as compared to the conventional downward load applied to the top.

From the relationship between skin friction, shaft length, shaft diameter, and end bearing shown in FIG. 6, the following example is given for a four-foot diameter shaft in a hole which is twenty feet deep, with an ultimate shear resistance between the concrete and the soil (skin friction) of 2000 lbs./sq. ft. (This is indicative of medium stiff clay.) A pressure of 300 psi. is required in the device to overcome the skin friction and the weight of concrete. The shaft weighs 20 tons and requires 22 psi. to lift it. Therefore the net pressure is 278 psi., equivalent to 250 tons. Thus the ultimate downward bearing capacity is at least 500 tons. Since the testing device cannot be exactly the same diameter as the shaft, a calculation was made for a 4.0-foot diameter shaft assuming the device is 3.8 feet in diameter. The required pressure is 10.8% greater than if the device was 4.0 feet in diameter.

Another embodiment includes an expansion means made of a reinforced rubber-like bag 78 filled with sand or a fluid material such as cement grout, oil or a mixture of cement grout and sand or a combination thereof. With this bag configuration, the expansion means can be lowered into a shaft which is enlarged or belled at the bottom as shown in FIG. 8. When the fluid is pumped down the shaft, the bag expands to fill the entire diameter of the enlarged bottom.

Still another embodiment of the invention may use two circular plates 20, 22. However, instead of the bellows-like arrangement 22, 38, 34, 36, 42, a rubberized fabric bag or balloon is attatched to and sealed at the neck of the balloon 78 to the pipe 24. When inflated, the bag will expand, producing the same results that are achieved by pushing the two plates 20, 22 apart. The preferred operating pressure range inside the bag is 300 to 800 psi. and the range is from about 200 to 1200 psi.

The load-testing device 54 need not be made of steel or to have the shape and dimensions shown. The device can also be made of concrete. In greater detail, FIG. 9 shows two cast concrete discs 80, 82 surrounded by a heavy rubber casing 84, which is somewhat similar to an automobile tire casing. The pipe 24 ends at the bottom in an integral flange 86 which is embedded in concrete disc 80, when it is cast. Likewise, the rod 32 terminates in a similar flange 88, which is embedded in disc 82, when it is cast. A number of spacer pins 90, 92 are embedded in at least one of the concrete discs 80 to hold them some minimum distance apart, such as one-fourth inch, for example.

When a fluid is pumped down the pipe 24 and into the space between the concrete discs 80, 82, the results are the same as described above in connection with FIG. 3. The casing 84 is an inflatable rubber-like doughnut which helps to contain the fluid being pumped down the pipe 24.

FIG. 10 shows a first alternative embodiment wherein the expansion means include a replacement of a heavy rubber casing 84 by a similar casing 94 which is U-shaped with the open ends of the "U" cast into the concrete discs 80, 82. In the second alternative embodiment (FIG. 11), the expansion means in the form of a heavy rubber casing 95 is a sleeve secured to the discs by straps 96, 97 which are held and tightened together by turnbuckles 102. In a third alternative embodiment (FIG. 12), the expansion means uses a rubber casing 102 which is a generally cylindrical member held in place by a pair of hose clamps 104, 106 which fit into grooves circumferentially formed about the periphery of each of the concrete discs 80, 82. In each of these three alternative embodiments, the object of the casing is to form a doughnut-like device which contains the fluid with sufficient force to cause the discs 80, 82 to move apart.

To extend the use of the inventive device, the structure and techniques shown in FIGS. 13–16 may be used for testing the load-bearing capacity of concrete-filled earthen shafts which are to be driven as piles for providing a foundation. Driven piles are commonly used as foundations for supporting buildings, bridges and other load-bearing structures. The piles may be made of wood, steel, concrete, or steel shells which are filled with concrete after they have been driven into place. The piles may be driven by a single or double acting hammer, a diesel hammer, or a vibratory hammer.

Pile design capacities may vary from around 25 tons for wood piles to as many as hundreds of tons for other types of piles and thousands of tons for very lrge specially designed piles. The most commonly used piles are those which are approximately one foot in diameter and have load-bearing capacities in the range of 40 to 200 tons. The inventive testing device is not restricted to any particular piles; however, it may be of greatest value when applied to these most commonly used piles. This inventive device eliminates the need for the conventional reactive system and shortens the time required for conducting the test, thereby greatly reducing the cost of testing.

Since the diameter of a driven pile is smaller than the diameter of a drilled shaft, the diameter pile testing device must be smaller than the diameter of the testing device for the drilled shaft. In addition, since the cross-sectional area of the pile is smaller than the cross-section of the drilled shaft, larger pressures are required inside the device to reach the ultimate capacity. In addition, any portion of the device which is attached to the end of a pile before it is driven, must withstand the forces caused by pile driving. This is unlike the test device for drilled shafts, which may be installed in the hole after the shaft is drilled and before the concrete is poured.

The driven pile has an expansion means 118 (FIG. 13) attached to its lower end. This device 118 includes a thick wall pipe 120 with a lower section piston 122 fitted with a pair of O-ring seals 124 in the space between piston 122 and cylinderical pipe 120. An upper section 126 is welded across the interior of pipe 120 to seal off the space 128 between the upper section 126 and the piston 122, thereby making a leak-proof chamber 128 surrounding the piston which may act under large hydraulic pressures (e.g. 3000 psi).

The expansion means 118 (FIG. 13) is welded to the bottom of a pile 130 (FIG. 14) which is to be tested. The device can be used on many types of piles, such as a pipe pile, for example. The pile 130, with the device 118 welded on the bottom, is then driven in any manner that may be used to drive other piles on the same job so that the test pile is representative of all piles used on the same job.

After the driving is complete, the outer pipe 24 is lowered into the pile and screwed into threaded hole 132 upper section 126 (FIG. 13). The upper surface of section 126 has a conical shape 134 so that the outer pipe 24 easily slides into the threaded hole 132. The inner pipe or rod 32 (FIG. 14) is then inserted inside the outer pipe 24 and screwed into the threaded hole 136 in the top of the piston 122. Again, the top surface of the piston 122 has a small conical shape 138 to guide the inner pipe or rod 32 into the threaded hole 136 in the piston 122.

The pipe 130 is then filled with concrete. After the concrete has cured sufficiently, the pile testing can proceed. However, if the pile is a pipe pile, it can be tested before being filled with concrete. With such an unfilled pipe, more information can be found concerning the distribution of friction along the pile.

FIG. 15 shows the pile testing device with pressure applied to move the piston to a partially extended position.

At the top of the hole, (FIG. 16), there is an apparatus for applying pressure and for measuring the resulting vertical movements that are described above in connection with FIG. 6. If the steel pipe 130 is not filled with concrete, an additional dial 140 can be attached to the top of the pipe.

As the load is applied by pumping a fluid down pipe 24, there is a movement at both the top and the bottom of the pipe, relative to a fixed reference beam 141. From these movements, the elastic shortening of the pipe can be calculated and the distribution of the friction forces along the pile length can be estimated.

The actual force distribution can be more accurately determined by having additional rods attached at several locations to the inside of the pipe 130. These additional rods extend upwardly to the surface where their movements can be measured with dial gages, again taken relative to the fixed reference beam 141. From these measurements, incremental elastic shortening along the length of the pipe can be calculated, from which incremental friction forces can be estimated.

For routine testing, the pile is preferably tested after having been filled with concrete 142 (FIG. 15). Then the total friction can be determined from an upward force-movement curve determined by the pressure gage 144 (FIG. 16) and by the dial gage 146 attached to the outer pipe 24. Gage 146 has a feeler probe 148 resting on the immovable reference beam 141 which is supported by the earth and does not move with pipe 130. Gage 146 is attached to the pipe 24; therefore, if pipe 24 and gage 146 rise, the feeler probe 148 lengthens and the amount of movement appears on the dial of gage 146. Gage 150 is similar to gage 146. It is attached to central rod 32 at 152. A freely floating feeler probe 154 rests on reference beam 141. If the rod 32 goes up or down, feeler probe 154 extends or retracts to give a reading on the dial 150. when the pipe 130 is not filled with concrete, an additional gage 140 (FIG. 16) is used. Gage 140 is attached to the reference beam 141 and its freely floating feeler probe rests on the top of the pipe 130. The difference in readings between gages 140 and 146 for any applied upward load measured by pressure gage 144 is the elastic compression of the pipe due to the distribution of the skin friction force along the pipe. By knowing Young's modulus for the steel, the distribution of the skin friction along the pipe due to the upward applied load can be estimated.

The inventive expansion means 118 (FIG. 13) can be attached to various types of corrugated shell piles before driving and then used for testing after the shell is filled with concrete. The expansion means 118 can also be used on the bottom of a precast concrete pile. For this type of pile, a pipe which is slightly larger than the outer pipe 24 is placed in the center of the pile before it is cast. The outer pipe 24 can then be inserted through this larger pipe after the pile is driven. Also, a steel plate is cast in the bottom of the concrete pile. The inventive device is coupled to this steel plate before the concrete pile is driven.

If the end resistance (commonly called "end bearing" or "point bearing") is greater than the side resistance (commonly called "skin friction"), the pile can be tested further for end bearing capacity. Since the side friction is still acting, the additional downward force required at the top is the difference between the end bearing and the skin friction. This load is much smaller than the total load reaction needed at the surface for a conventional load test. This load can be supplied by moving a crane or other heavy machinery over the top of the pile and using it as a reaction mass.

Alternatively, two adjacent piles which were driven previously can be used as hold down piles with a reaction beam extending between them and over the top of the test pile. Since each of the two adjacent piles have approximately the same uplift capacity as the test pile which has already been tested in side or skin friction, the additional hold down capacity added to the system is now twice the tested side friction. In most cases, there is more than enough side friction in the two adjacent piles to test the ultimate end bearing capacity of the test pile. The additional load is much less than the total reaction load needed to test the total end bearing and side friction capacity in a conventional load test. The size and cost of the reaction system to test for ultimate end bearing is greatly reduced in the case where the end bearing is found after the ultimate side friction has been reached. However, in most cases, test loads are required only to prove that the design load per pile requirements are being met. It is only necessary to test until the pile faile in either side friction or end bearing. With either failure mode, the actual and ultimate downward load capacity is at least twice the measured test capacity with the inventive device.

After all testing is completed, and the gages 140, 144, 146, 150 (FIG. 16), reference beam 141, and upper connections are removed. The pile can thereafter be driven downwardly a few inches to re-establish the contact between the pipe and the bottom of the piston in order to restore the full end bearing and skin friction capacity that was established before the testing. If a test indicates that the pile capacity is less than expected, the pile can be driven an appropriate distance further into the ground and then retested.

The inventive device can be used as a permanent attachment at the end of a pipe pile and thus becomes a special test pile which can be extracted from the ground with a conventional pulling hammer or vibratory hammer. Then, the pipe pile may be re-used. The device, attached permanently to a pipe can also be made smaller than the inside diameter of the pile which is to be tested so that it can be inserted inside a driven pipe and attached rigidly at the top. The piston can push a bottom plate which is tack welded to the bottom of the test pile. After the testing is completed, the test device is removed and the pipe filled with concrete.

The test device need not be the same diameter as the pile to be tested. Larger diameter piles can be tested by welding the device to a plate which is, in turn, welded to the bottom of the larger pile. An additional plate of the same or a slightly larger diameter than the test pile can be attached to the bottom of the piston.

In a special circumstance in which a footing is supported by a number of piles, and when the requirements are that the footing remain at a precise elevation, and if the nature of the ground is such that it cannot support the structure at the required close vertical tolerances, the inventive device can be used as described if permanently installed in each of the piles. As the footing moves slightly out of tolerance, each pile can by hydraulically jacked to adjust the footing to be at the required position.

Those who are skilled in the art will readily perceive how to modify the system. Therefore, the appended claims are to be construed to cover all equivalent structures which fall within the scope and spirit of the invention.

I claim:

1. A device for separately measuring the load-bearing capacity of an earthen substrate at the bottom of a hole and of the skin friction between the walls of the hole and a shaft in the hole, said device comprising a vertically acting expansion means resting flat on the bottom of said hole, means extending from the surface of the earth to said expansion means for transmitting a pressurized fluid from the top of the shaft to the expansion means at the bottom of the hole thereby expanding the expansion means to transmit upwardly and downwardly acting forces at the top and bottom of the expansion means, and means responsive to said transmission of fluid into said expansion means for measuring upward movement of the top of the expansion means to measure skin friction and for measuring downward movement of the bottom of the expansion means to measure underlying support capabilities.

2. The device of claim 1 wherein the applied pressurized fluid causes equal upward and downward forces, said upward force pushes the shaft upward and measures the skin friction, and said downward force causes the expansion means to be pushed downwardly to measure the resistance of the underlying supporting earth at the bottom of the shaft.

3. The device of claim 1 wherein said expansion means is bellows like which comprises a spaced parallel pair of plates separated by two somewhat toroidally-shaped plates, said toroidally-shaped plates being joined together at their inside diameter and being joined at their outside diameter to the adjacent ones of said two plates.

4. The device of claim 3 and a pipe joined to the center of an upper one of said two plates, and a rod passing coaxially through said pipe to a junction with the center of the bottom plate whereby the relative movements of said rod and pipe indicate the movements of said two plates.

5. The device of claim 4 and means associated with said rod at the top of said hole for measuring the downward movement of the bottom of said two plates.

6. The device of claim 1 wherein said expansion means is a pair of spaced parallel cement discs peripherally surrounded by a heavy elastic jacket that enables the space between the discs to expand.

7. The device of claim 1 wherein said expansion means is an elastic bag attached to the end of a pipe whereby the volume of said bag increases and the shape of the bag increases to fill a space at the bottom of said shaft regardless of the geometry of said space.

8. The device of claim 1 wherein said expansion means is a heavy duty piston inside a cylinder, said expnsion means being attached to the end of a driven pile.

9. The device of claim 8 and at least one O-ring sealing an outside periphery of said piston to the inside periphery of said cylinder.

10. A device for separately measuring the load-bearing capacity of an earthen strata at the bottom of a hole and the skin friction between a shaft and the wall of an earthen hole, said device comprising upper and lower spaced parallel expansion means joined at their peripheries to enable said expansion, whereby said expansion may move apart responsive to a pressurization of the space between said upper and lower expansion means, means for lowering said device to lie flat on the bottom of said hole, said lowering means including a coaxial pipe and rod extending from the upper surfaces of said upper and lower expansion means respectively, means for transmitting a pressurized fluid from the top through the pipe to the space between the upper and lower expansion means at the bottom of the hole, said pressurized fluid expanding said expansion means, and means for measuring upward movement of the pipe and downward movement of the rod responsive to the expansion which occurs when the fluid is transmitted into said expansion means.

11. The device of claim 10 wherein said expansion means includes spaced parallel plates in the form of two cast concrete discs, said pipe terminating at its bottom in a flange embedded in the upper cast concrete disc, said rod terminating in a flange embedded in the lower cast concrete, means for normally holding said discs a minimum distance apart, and flexible means surrounding the periphery of the discs for sealing the space between them.

12. The device of claim 11 wherein said flexible means is a rubber-like doughnut member having a U-shaped cross-section with the circumferential periphery of said concrete discs embraced within the U.

13. The device of claim 11 wherein said flexible means is a rubber-like sleeve extending across the circumferential space between the discs.

14. The device of claim 13 wherein said sleeve is held in place by a plurality of straps which are tightened by turnbuckles.

15. The device of claim 13 wherein said sleeve is held in place by circumferential clamps around the periphery of each of said discs.

16. The device of claim 10 wherein said expansion means is a heavy duty piston inside a cylinder, said expansion means being attached to the end of a driven pile.

17. The device of claim 16 and at least one O-ring sealing an outside periphery of said piston to the inside periphery of said cylinder.

18. A method of separately measuring skin friction and the supporting capacity of an underlying earthen area, said method comprising the steps of:

(a) forming a hole in the earth;

(b) placing an expansion means in the bottom of the hole, the peripheries of said expansion means being joined by a space confining means;

(c) positioning a shaft in said hole and over said expansion means;

(d) pumping a fluid into the confined space within the expansion means, whereby said confined space is forced to open; and (e) measuring both any upward motion of the shaft and any downward motion of the earth under the shaft.

19. The method of claim 18 and the added step of extending a pipe from an upper side of said confined space to the top of the hole for enabling said fluid to be pumped down the hole and of extending a rod coaxially down the pipe to the bottom of said confined space, whereby the downward movement may be measured by observing movement of said rod.

20. The method of claim 19 and the added step of securing a reference beam over said hole independently of the equipment in the hole, and means for conducting said measurements by observing movements of said rod and said pipe relative to said reference beam.

21. A device for testing the load-bearing capacity of a shaft in the earth, said device comprising a coaxial rod and pipe extending from the top of the earth down approximately the center of the shaft to the bottom of the shaft, an inflatable rubber-like doughnut associated with the bottom of said coaxial rod and pipe and positioned between the bottom of said shaft and the underlying earth, and means for detecting movement of the tops of said rod and pipe responsive to fluid pumped down said pipe to said rubber-like doughnut.

* * * * *